US006493290B1

(12) United States Patent
Terzian

(10) Patent No.: US 6,493,290 B1
(45) Date of Patent: Dec. 10, 2002

(54) FINAL MINUTE GRAPHICS FOR DIGITAL TIME DISPLAYS

(75) Inventor: Berj A. Terzian, Newbury, MA (US)

(73) Assignee: Equitime, Inc., Newbury, MA (US)

( * ) Notice: Subject to any disclaimer, the term of this patent is extended or adjusted under 35 U.S.C. 154(b) by 10 days.

(21) Appl. No.: 09/901,420

(22) Filed: Jul. 9, 2001

(51) Int. Cl.[7] ..... G04C 19/00
(52) U.S. Cl. ..... 368/82; 368/239
(58) Field of Search ..... 368/82–84, 239–242

(56) References Cited

U.S. PATENT DOCUMENTS 4,194,352 A 3/1980 Terzian
4,264,966 A 4/1981 Terzian
4,270,196 A 5/1981 Terzian
4,271,497 A 6/1981 Terzian
4,483,628 A 11/1984 Terzian
4,600,316 A 7/1986 Besson
4,627,737 A 12/1986 Nance et al.
4,671,673 A 6/1987 Terzian
4,720,823 A 1/1988 Terzian
5,757,730 A 5/1998 Terzian
5,805,534 A 9/1998 Terzian
6,215,736 B1 4/2001 Terzian

*Primary Examiner*—Vit Miska
(74) *Attorney, Agent, or Firm*—Lucas & Just

(57) ABSTRACT

Digital time displays which include a display of remaining minutes, on the left side, and before commencement of a displayed next hour, such as quadribalanced or enhanced quadribalanced displays, are provided with improved systems and methods of graphics for tracking and portraying the diminishing period of the last 59 seconds before commencement of the next hour.

23 Claims, 3 Drawing Sheets

FINAL MINUTE GRAPHICS FOR DIGITAL TIME DISPLAYS

BACKGROUND OF THE INVENTION

I. Field of the Invention

This invention relates to digital time displays which are useful for general purpose timekeeping, meaning the usual habits of individuals in watching and keeping track of the time while going about their daily activities.

II. Description of the Prior Art

Quadribalanced and Enhanced Quadribalanced digital time displays are described in U.S. Pat. No. 4,271,497 (hereinafter '497 patent) and U.S. Pat. No. 6,215,736 B1 (hereinafter '736 B1 patent), respectively, the disclosures of which are incorporated herein by reference. The '497 patent does not indicate what should be included in its displays during the final minute of each hour, when zero minutes and 59 to zero seconds remain until the commencement of the next hour.

The '736 B1 patent teaches at column 6, lines 55–59 that its displays can include flashing horizontal elements during the period of the last minute before the next hour, in a manner described in U.S. Pat. No. 5,757,730 (hereinafter '730 patent), the disclosure of which is incorporated herein by reference.

III. Recognition of Problems in the Prior Art

The present applicant made several attempts to implement the teaching of the '497 patent to use flashing horizontal elements: like those described in the '730 patent, in the enhanced quadribalanced displays of the '736 B1 patent during the final minute, while seconds were counted down from 59 to zero. These attempts were not successful. Basically, the problem was a lack of proportion and fullness in the limited area occupied by the flashing uppermost six horizontal elements of the '736 B1 patent displays, compared to the larger area of the entire space on the left of the displayed next hour which is fully occupied in such displays by remaining minutes during the last thirty minutes before the next hour.

The flashing uppermost six horizontal elements gave the appearance and impression of being too crowded and disproportionate in their collective grouping and position, as contrasted from the larger area of the entire available space used to display remaining minutes during the preceding half hour. These problems did not become apparent until the present applicant's attempt to implement the teachings of the '497 and '730 patents in the displays of the '736 B1 patent, as explained above.

SUMMARY OF THE INVENTION

The present invention provides an effective solution to the above-described problems, with considerable unexpected additional benefits and advantages that were not foreseen before the initial concept of the invention emerged in the applicant's thought processes. In particular, while mentally dealing with the above problems, the initial concept suddenly recognized that the 10-segmented ladder arrays, used to display remaining minutes during the second half hour of the '736 B1 patent, at zero remaining minutes, could be transformed into two sets of three zeros each, stacked in vertical alignment one above the other, in the whole of space occupied by the previous 59 remaining minutes. Therefore, during the final minute, each of these equi-sized zeros, occupying substantially one-third of the area of that space, could be displayed in a predetermined pattern or sequence to graphically track the diminution of the last 59 seconds of the final minute. Moreover, such zeros would provide direct and explicit confirmation that all minutes of the current hour have passed and only seconds remain before the commencement of the next hour. After these breakthrough insights, the invention came into clear focus as a far superior display system and method for the final minute of the enhanced quadribalanced time displays of the '736 B1 patent, or analogous time displays, as further discussed below.

DESCRIPTION OF THE PREFERRED EMBODIMENT

Figure 1:
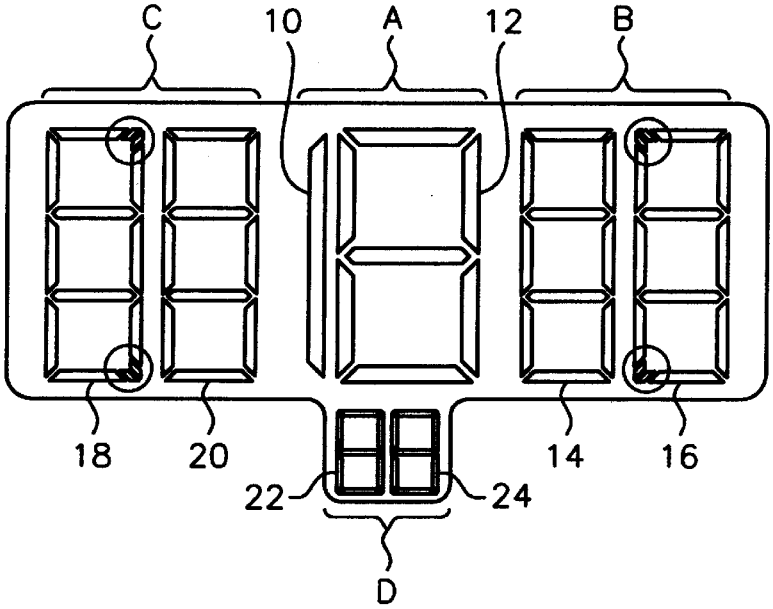
FIG. 1 (Prior Art)
FIG. 1 is a modified version of FIG. 1 of the '736 B1 patent.

Referring now to FIG. 1, bracket A references a set of display elements comprising a vertical display element 10 flanked on the right by a FIG. 8 group of display elements 12 which can be activated to display hour values of 1 through 12.

Bracket B references a set of display elements comprising two groups each of 10-segmented ladder-arrayed display elements 14 and 16 which can be activated to display 00 to 15 and 16 to 30 elapsed minutes past an existing hour, in relatively upper and lower, partially overlapping positions during the first and second quarters of the hour, as taught in the '736 B1 patent.

Bracket C references another set of display elements comprising two groups each of 10-segmented, ladder-arrayed display elements 18 and 20 which can be activated to display 29 to 16 and 15 to 01 remaining minutes before a next hour, in relatively lower and upper, partially overlapping positions during the third and fourth quarters of the existing hour, as also taught in the '736 B1 patent.

Bracket D references a set of display elements comprising two FIG. 8 groups of display elements 22 and 24 which can be activated to display 0 to 59 seconds during each elapsed minute displayed by elements B, as well as 59 to 0 seconds during each remaining minute displayed by elements C, as taught in the '736 B1 patent.

Finally, certain encircled uppermost and lowermost comers of the outboard 10-segmented group of elements in stacks B and C can be activated to display markers in those quadrants of the minute areas not occupied, respectively, by displayed minutes during the course of an hour, again as taught in the '736 B1 patent.

Figure 2:
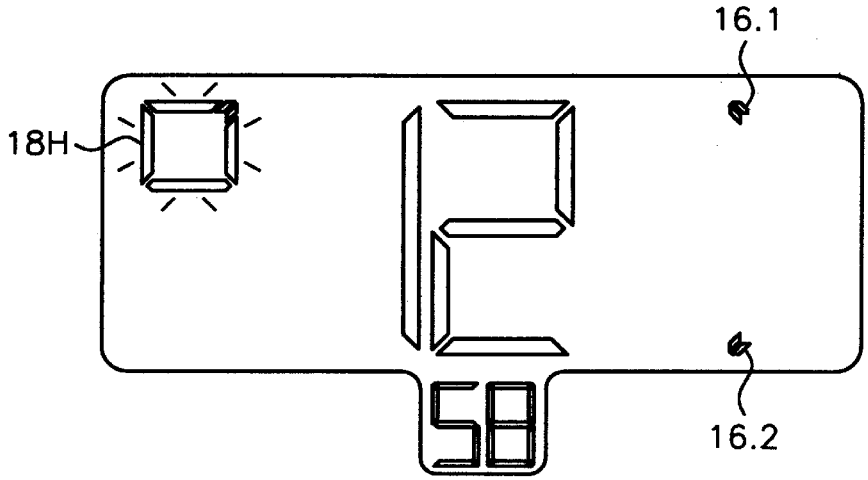
FIGS. 2–7 are representative displays of selectively activated elements of the FIG. 1 display to graphically track the diminution of the final 59 seconds before commencement of a next hour 12, in accordance with a preferred embodiment of the present invention.

Referring next to FIG. 2, displayed there is the representative exact time of zero minutes and 58 seconds before the next hour 12. The highest zero 18H in the stacked 10-segment array 18 (FIG. 1) has been activated and is surrounded by ray lines to portray the fact that it Is flashing. This flashing continues during the ten second period from 59 to 50 seconds. The markers 16.1 and 16.2 are optionally, but preferably also, activated to fill out, and provide a sense of counterbalance in, the empty elapsed minutes space on the right flank of the hour 12, relative to the flashing zeros in the left flank area.

Figure 3:
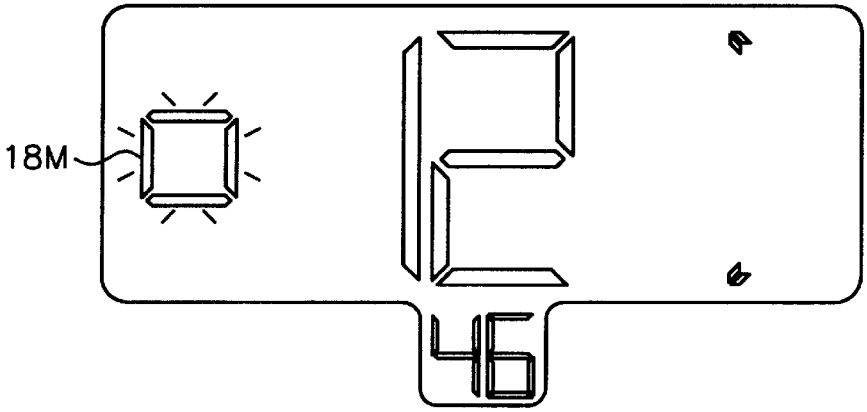

FIG. 3 displays the representative exact time of zero minutes and 46 seconds before the next hour 12. Here, the middle zero 18M of the array 18 (FIG. 1) has been activated into flashing condition during the ten second period from 49 to 40 seconds.

Figure 4:
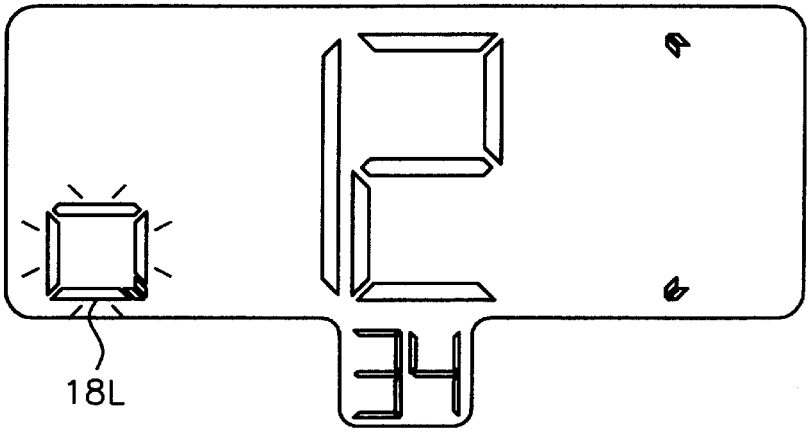

FIG. 4 displays the representative exact time of zero minutes and 34 seconds before next hour 12. The lowermost zero 18L of the stack 18 (FIG. 1) has been activated to flash during the period from 39 to 30 seconds which concludes the first half of the final minute before the next hour.

Figure 5:
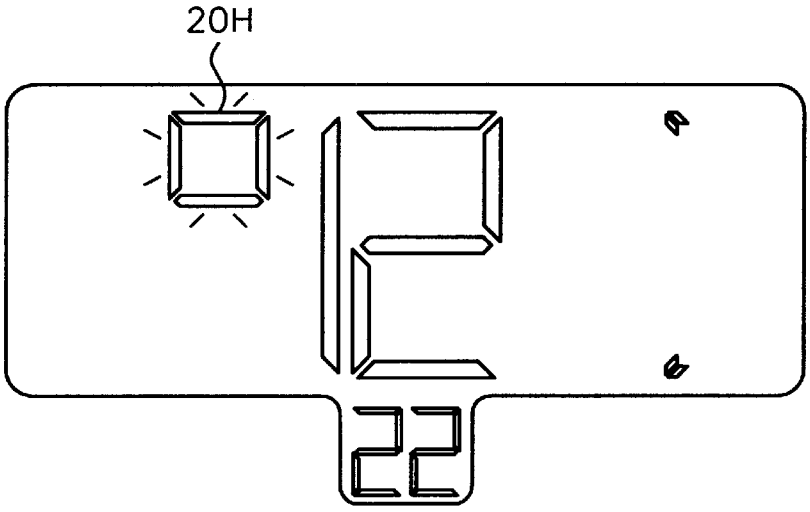

FIG. 5 displays the representative exact time of zero minutes and 22 seconds before next hour 12. Now, the uppermost zero 20H of the stack 20 (FIG. 1) has been activated to flash during the period from 29 to 20 seconds. Thus, the previous trio of zeros 18H, 18M and 18L, has completed its course from top to bottom of the outboard space on the left of the displayed next hour exactly at the conclusion of the next-to-last 30 seconds before the next hour. Thereafter, FIG. 5 begins a second downward progression of a trio of flashing zeros starting with 20H which is the highest of the three and located in the closer inboard position adjacent the displayed next hour 12.

Figure 6:
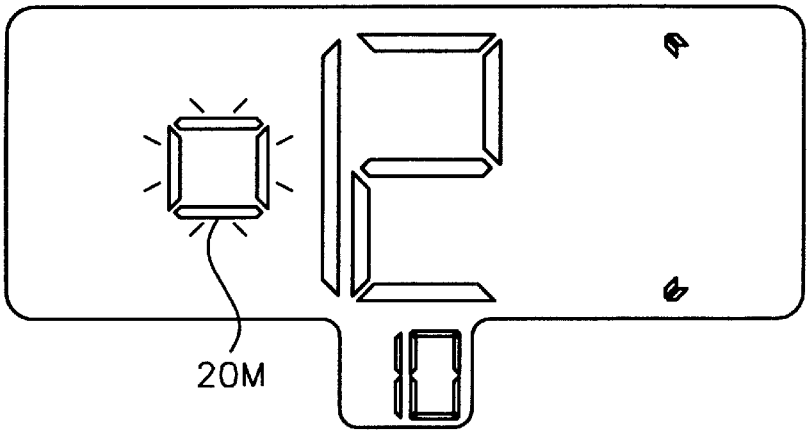

FIG. 6 displays the representative exact time of zero minutes and 10 seconds before next hour 12. Here, the middle zero 20M of the stack 20 (FIG. 1) has been activated to flash during the period of 19 to 10 seconds before the next hour.

Figure 7:
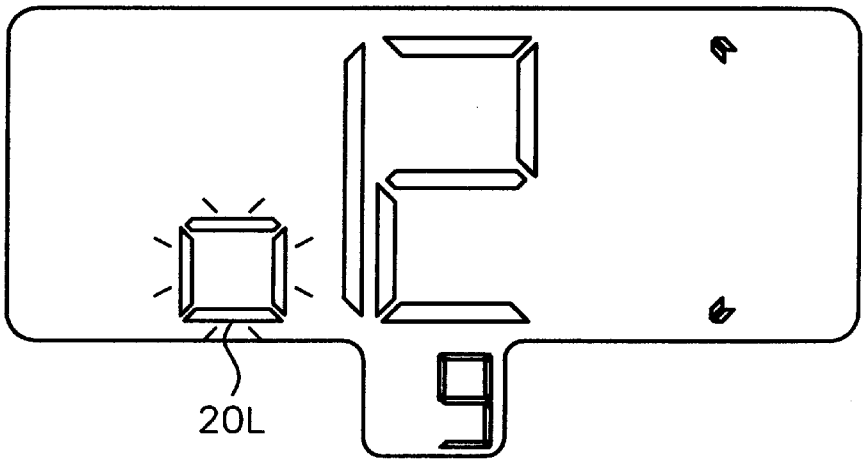

Finally, FIG. 7 displays the position occupied by the lowermost zero 20L of the stack 20 (FIG. 1) during the last ten second period before next hour 12, at the representative exact time of zero minutes and 9 remaining seconds.

The invention has been described in terms of its functional principles and a specific preferred embodiment. Because in the preferred embodiment its elements comprise six equi-sized zero digits located in six different positions during the final minute before a next hour, it offers much flexibility and many choices of selected predetermined patterns or sequences of flashing and display positions.

In particular, FIGS. 2–7 have been designed to illustrate a preferred pattern and sequence comprising a relatively slow rate of flashing during the first thirty seconds, i.e., zero digits 18H, 18M and 18L in FIGS. 2–4, a faster rate of flashing of zero digits 20H, 20M in FIGS. 5 and 6, and a final, still faster rate of flashing of zero digit 20L in FIG. 7.

More specifically, zero digits 18H, 18M and 18L are preferably flashed at a rate of one every other second commencing at 58 seconds, such that the zeros will flash 5 times during the initial ten second period of 59 to 50 seconds. Each flash in this period will occur on the even numbered values of seconds ending with 50.

Likewise, zero digits 18M and 18L are preferably flashed at the same rate as zero digit 18H at each of the even numbered seconds values of their ten second periods, 49–40 and 39–30, ending with values 40 and 30, respectively.

Zero digits 20H and 20M are flashed at a faster rate of once every second during their ten second periods of 29–20 and 19–10, respectively. Accordingly, this higher rate is double the rates of the first 30 seconds tracked by zero digits 18H, 18M and 18L. The resulting ten flashes of the two zero digits 20H and 20M during each of their ten second periods gives a more attention-drawing, alerting effect to the viewer that the next hour is approaching more closely, as distinguished from the first thirty second period tracked by the more leisurely flashing zero digits 18H, 18M and 18L.

Finally, zero digit 20L of FIG. 7 is preferably flashed again at a doubly faster rate than the zero digits 20H and 20M. This results in each value of the remaining ten seconds being accompanied by two flashes of the zero digit 20L, thus providing the strongest alert effect that the next hour 12 has nearly arrived.

One can envision the overall result by considering such a flashing sequence during the final minutes of New Year's Eve. During the first thirty seconds, i.e., the first half of that minute, the viewer will be mildly alerted to prepare for the approaching new year. The next alert level will be a notch higher during the next twenty seconds, due to the doubled rate of flashing. Finally, the last ten seconds will present a still more urgent alert level by a yet further doubled flashing rate which is appropriate to timely prepare the viewer for the celebrations that are performed at the arrival of each New Year.

The foregoing is only one specific example of the choice of specific patterns or sequences of flashing zero digits and positions enabled by the present invention. For example, a selected single rate of flashing can be chosen for all of the ten second periods tracked by the downward progressions of the zero digits. Or, reciprocating flashing zero digits down and up between successive positions can be implemented, in whole or in part. Still another option is to begin with, or intersperse steady zero digits with flashing zero digits, or to use only steady zero digits in the illustrated incremental position changes, during selected successive values of seconds. Other patterns and sequences will be readily evident to those skilled in the art.

The invention has direct application in the quadribalanced and enhanced quadribalanced digital time displays described in the '497 and '736 B1 patents. The invention more generally can be embodied in any digital time display which includes a display of remaining minutes on the left side and before commencement of a displayed next hour, after such remaining minutes have reached a value of zero.

Thus, many variations of the foregoing disclosure will be obvious to those having ordinary skill in the art of time display systems and methods. Accordingly, it should be understood that the ensuing claims are intended to cover all changes and modifications of the above-described specific preferred embodiment which fall within the literal scope of the claims and all equivalents thereof.

The following is claimed:

1. In a digital time display which includes a display of remaining minutes, on the left side and before commencement of a displayed next hour, a system of improved graphics for tracking the diminution of the final remaining minute which comprises a plurality of zero digits positioned on the left side of the displayed next hour in a predetermined pattern, said zero digits being activatable in a predetermined sequence which graphically portrays the diminishing period of the last 59 seconds before the commencement of the next hour.

2. A system according to claim 1 wherein the plurality comprises six zero digits grouped in one outboard stack and one inboard stack relative to the displayed next hour, each stack containing three zero digits in vertical alignment over each other.

3. A system according to claim 2 wherein the three digits of the outboard stack are separately and incrementally flashed in the sequence of initially the highest zero digit during 59 to 50 seconds, next the middle zero digit during 49 to 40 seconds, and thereafter the lowest zero digit during 39 to 30 seconds.

4. A system according to claim 3 wherein the rate of flashing of all three zero digits is once every other second commencing with 58 seconds and continuing with all subsequent even numbered values of seconds down to and including 30 seconds.

5. A system according to claim 3 wherein following the time of 30 remaining seconds the three digits of the inboard stack are separately and incrementally flashed in the sequence of initially the highest zero digit during 29 to 20 seconds, next the middle zero digit during 19 to 10 seconds, and finally the lowest zero digit during 9 to zero seconds.

6. A system according to claim 5 wherein the highest and middle digits are flashed at the rate of once every second and the lowest zero digit is flashed at the rate of twice every second.

7. A system according to claim 1 wherein the zero digits are separately and incrementally activated in a steady state condition, in a predetermined sequence.

8. A system according to claim 1 wherein the zero digits are activated separately and incrementally in both a steady state condition and a flashing condition, in a predetermined sequence.

9. A system according to claim 1 wherein the zero digits are separately and incrementally flashed at a uniform rate.

10. In a quadribalanced or enhanced quadribalanced digital time display which includes a display of remaining minutes, on the left side and before commencement of a displayed next hour, a system of improved graphics for tracking the diminution of the final remaining minute which comprises a plurality of zero digits positioned on the left side of the displayed next hour, said plurality comprising six zero digits grouped in one outboard stack and one inboard stack relative to the displayed next hour, each stack containing three zero digits in vertical alignment over each other, said zero digits being activatable into visibility in a predetermined sequence which graphically portrays the diminishing period of the last 59 seconds before the commencement of the next hour.

11. A system according to claim 10 wherein the three digits of the outboard stack are separately and incrementally flashed in the sequence of initially the highest zero digit during 59 to 50 seconds, next the middle zero digit during 49 to 40 seconds, then the lowest zero digit during 39 to 30 seconds, next the highest zero digit of the inboard stack during 29 to 20 seconds, thereafter the middle digit of the inboard stack during 19 to 10 seconds, and finally the lowest zero digit of the inboard stack during 9 to zero seconds.

12. A system according to claim 11 wherein the six zero digits are flashed at varying rates comprising once every other second for all three digits of the outboard stack, once every second for the highest and middle zero digits of the inboard stack and twice every second for the lowest zero digit of the inboard stack.

13. A system according to claim 12 wherein flashing of all three zero digits of the outboard stack commences at 58 seconds and continues with all even numbered values of seconds down to and including 30 seconds.

14. A system according to claim 11 wherein markers are simultaneously displayed on the right side of the displayed next hour in the two spaces where elapsed minutes are displayed during the first and second quarter hours of a current hour.

15. In a digital time display which includes a display of remaining minutes, on the left side and before commencement of a displayed next hour, an improved graphics method for tracking the diminution of the final remaining minute which comprises providing a plurality of zero digits on the left side of the displayed next hour in a predetermined pattern, and activating such digits into visibility in a predetermined sequence which graphically portrays the diminishing period of the last 59 seconds before commencement of the next hour.

16. A method according to claim 15, which further includes:

providing six zero digits grouped in two stacks, one stack outboard and one stack inboard relative to the displayed next hour, each stack containing three zero digits vertically aligned over each other; and separately and incrementally flashing the zero digits in a sequence of the highest, middle and lowest zero digits of the outboard stack, followed by the highest, middle and lowest zero digits of the inboard stack.

17. A method according to claim 16 which further includes:

flashing the first three zero digits at a rate of once every other second, flashing the next two zero digits at a rate of once every second, and flashing the last zero digit at a rate of twice every second.

18. A method according to claim 17 which further includes commencing the flashing of the first three digits at 58 seconds and continuing such flashing at all subsequent even numbered values of seconds down to and including 30 seconds.

19. In a quadribalanced or enhanced quadribalanced digital time display which includes a display of remaining minutes, on the left side and before commencement of a displayed next hour, an improved graphics method for tracking the diminution of the final remaining minute which comprises providing six zero digits on the left side of the displayed next hour grouped in one outboard stack and one inboard stack relative to the displayed next hour, each stack containing three zero digits in vertical alignment over each other, and activating such digits in a predetermined sequence which graphically portrays the diminution of the last 59 seconds before commencement of the next hour.

20. A method according to claim 19 which further includes separately and incrementally flashing the zero digits, in equal ten second periods, in the sequence of the highest, middle and lowest zero digits of the outboard stack, followed by the highest, middle and lowest zero digits of the inboard stack.

21. A method according to claim 20 which further includes:

flashing the first three zero digits at a rate of once every other second during the respective periods of 59 to 50 seconds, 49 to 40 seconds and 39 to 30 seconds, flashing the next two zero digits at a rate of once every second during the respective periods of 29 to 20 seconds and 19 to 10 seconds, and flashing the last zero digit at the rate of twice every second during the period of 9 to zero seconds.

22. A method according to claim 21 which further includes simultaneously displaying markers on the right side of the displayed next hour in the two spaces where elapsed minutes are displayed.

23. A method according to claim 19 which further includes providing zero digits which are equal in size.

* * * * *